US005358219A

United States Patent [19]

Shenk et al.

[11] Patent Number: 5,358,219

[45] Date of Patent: Oct. 25, 1994

[54] CRANE CLAW TILT SENSING AND RECOVERY

[75] Inventors: David K. Shenk, P.O. Box 191, Niwot, Colo. 80544; Anthony R. Fabrello, Loveland, Colo.

[73] Assignee: David K. Shenk, Longmont, Colo.

[21] Appl. No.: 812,184

[22] Filed: Dec. 20, 1991

[51] Int. Cl.[5] ..... B66C 13/06; B66D 1/56; A63H 17/12

[52] U.S. Cl. ..... 254/269; 212/147; 212/153; 273/448

[58] Field of Search ..... 254/274, 275, 266, 269, 254/270, 272; 212/146-148, 153, 161, 159; 221/210, 219; 294/82.1, 82.11, 82.12, 82.13, 82.15; 273/181 R, 129 S

[56] References Cited

U.S. PATENT DOCUMENTS

| | | | |
|---|---|---|---|
| 2,600,849 | 6/1952 | Collins et al. | 212/161 |
| 3,043,444 | 7/1962 | Melton | 212/147 |
| 3,743,107 | 7/1973 | Verschoof | 254/275 X |
| 4,118,012 | 10/1978 | Kerr et al. | 254/269 |
| 4,350,254 | 9/1982 | Noly | 212/153 |
| 4,376,487 | 1/1983 | Van Soest et al. | 212/146 X |
| 4,684,128 | 8/1987 | Verstraeten | 212/147 X |
| 4,710,819 | 12/1987 | Brown | 254/266 X |
| 4,842,150 | 6/1989 | Potocnjak | 212/147 |
| 4,883,184 | 11/1989 | Albus | 212/147 X |

FOREIGN PATENT DOCUMENTS

| | | | |
|---|---|---|---|
| 2247686 | 4/1974 | Fed. Rep. of Germany | 254/172 |

*Primary Examiner*—Clifford D. Crowder
*Assistant Examiner*—Ismael Izaguirre
*Attorney, Agent, or Firm*—Homer L. Knearl

[57] ABSTRACT

A crane claw tilt switch in addition to a cable tension switch is used to prevent a crane claw from becoming entangled in its suspending cable. When the claw lands on the floor or some other object, it either comes to rest or starts to tilt. If it comes to rest, further lowering creates cable slack, operating the tension switch. If it starts to tilt, the tilt switch operates before the claw tilts enough to allow an arm of the claw to catch on the cable. In response to the operation of either switch, a system processor commands the claw to automatically raise, ensuring that it does not become entangled in its cable.

8 Claims, 1 Drawing Sheet

CRANE CLAW TILT SENSING AND RECOVERY

BACKGROUND OF THE INVENTION

1. Field of the Invention

The present invention relates to devices for preventing a crane claw from becoming entangled in the cable suspending it. More particularly, the invention relates to crane claws with limited direct controls such that when the claw becomes entangled the crane controls are not capable of untangling the claw from the cable.

2. Description of Prior Art

Arcade games exist which utilize a miniature crane claw to pick up a prize. The player guides the claw as it is automatically lowered in an attempt to capture the prize the player wants. Occasionally, the claw is tilted to such a degree that it catches on the cable suspending it. It will not then correct itself, no matter how many times it is lowered and raised. A service person must travel to the location of the arcade game and disentangle the claw from its suspension cable. This is an expensive service call for a minor problem. In addition the crane and thus the game are out of operation until the service call is made; the out of operation time for the crane is additional loss to the owner of the game.

SUMMARY OF THE INVENTION

It is an object of this invention to prevent the crane claw from becoming entangled with its suspension cable.

In accordance with this invention the above objects are accomplished by automatically raising the claw when it tilts at least to some predetermined angle. The crane motor controlled by a data processor through a motor driver raises or lowers the crane claw by unreeling or reeling the cable suspending the claw. A cable tension switch operates when the cable becomes slack, and a tilt switch operates when the claw tilts to a critical angle Just less than the angle which would allow an arm of the claw to catch on the cable. The tension switch and the tilt switch are used in a logical "OR" configuration to feedback a signal to the processor. When either the cable becomes slack or the claw tilts to the critical angle, the processor tells the motor driver to reverse the motor and raise the claw. Thus, the claw is automatically lifted and straightened before an arm of the claw can catch on the cable. The great advantage of the invention is that unnecessary service calls for the crane and out of operation time for the game are minimized.

Other objects, advantages and features of the invention will be understood by those of ordinary skill in the art after referring to the complete written description of the preferred embodiment in conjunction with the following drawings.

DESCRIPTION OF THE PREFERRED EMBODIMENTS

Figure 1:
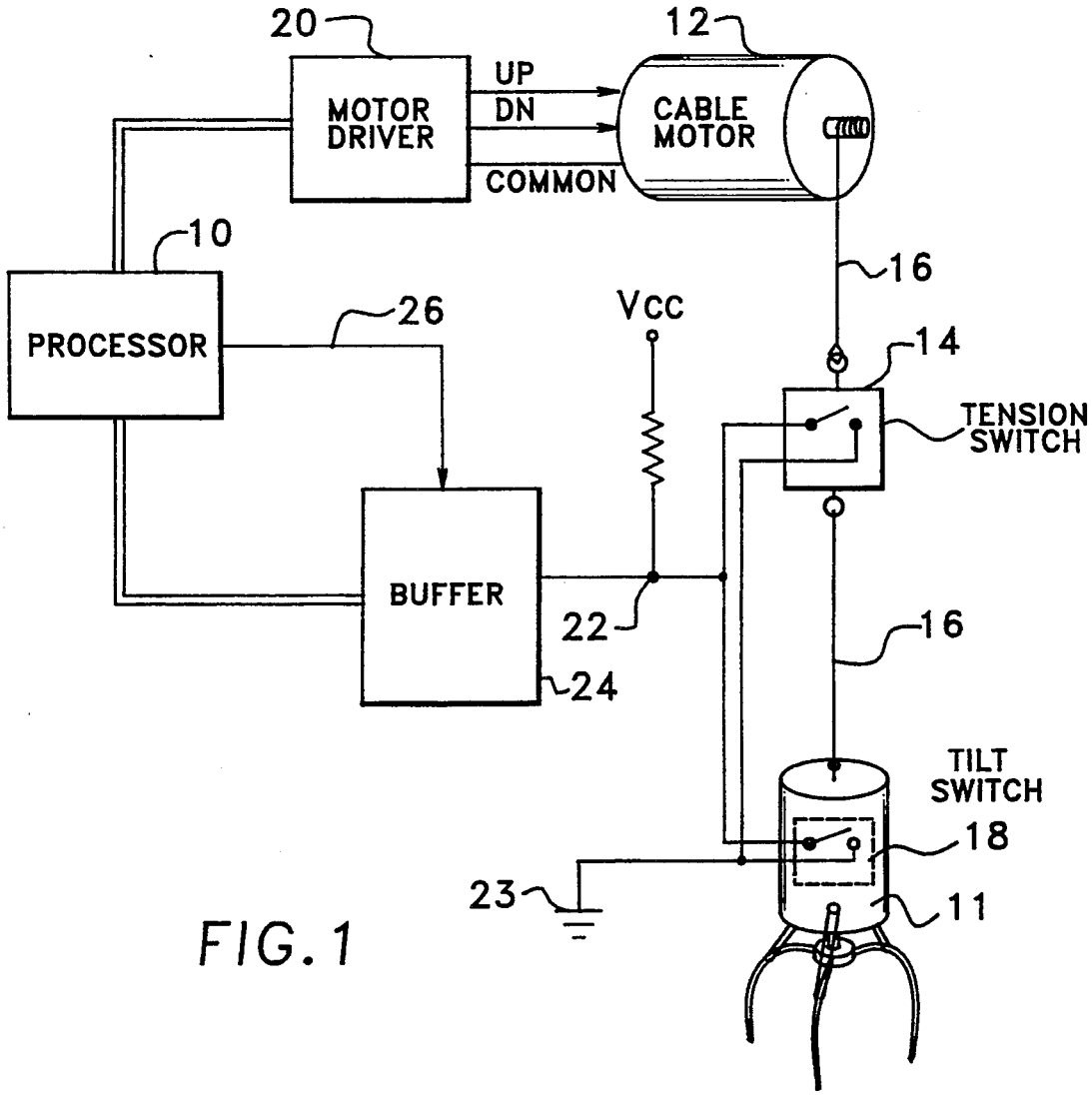
FIG. 1 is a diagram of the preferred embodiment of the invention.

In FIG. 1, the micro processor chip 10 generates digital commands for a motor driver 20. Motor driver 20 converts these digital commands to analog signals to control the application of power to and direction of motion of motor 12. An "up" signal from the motor driver causes the motor to rotate in a direction to reel-in cable 16. A "down" signal from motor driver 20 causes the motor to rotate in a direction to unreel cable 16. Motor 12 raises and lowers the claw 11 by reeling and unreeling cable 16, respectively. A cable tension switch 14 is inserted in cable 16. Claw tilt switch 18 is mounted in the top of the claw 11.

When the player starts the game, the data processor 10 commands motor driver 20 to lower the claw 11. When the claw hits the ground or some other object it either tilts or comes to rest. If the claw 11 comes to rest on the floor or some other object, continued operation of the motor removes tension from the cable 16, operating tension switch 14.

When tension goes out of cable 16 and tension switch 14 closes, the voltage at circuit node drops from $V_{cc}$ to ground. (The impedance into buffer 24 is very high.) The change in signal level of a bit in buffer register 24 is sensed by processor 10 when it sends a read signal over line 26 to buffer 24. When processor 10 reads the changed bit, it sends a command to motor driver 20 to raise claw 11.

If the claw 11 lands unevenly, it will tilt as cable 16 lowers the claw. Since the claw is tilting the tension switch 14 is not made because there is still tension in cable 16. However, when claw 11 tilts past a predetermined angle less than the critical angle which would allow the claw to catch on the cable 16, tilt switch 18 operates.

When tilt angle exceeds the predetermined angle, tilt switch 14 closes, the voltage at circuit node 22 drops from $V_{cc}$ to ground. The change in signal level of a bit in buffer register 24 is again sensed by processor 10 when it sends a read signal over line 26 to buffer 24. When processor 10 reads the changed bit, it sends a command to motor driver 20 to raise claw 11.

Tension switch 14 and tilt switch 18 are wired in a logical OR configuration relative to the input to buffer 24. The top terminals of the switches are tied together and connected to node 22. The bottom terminals of the switches are tied together and connected to electrical ground 23. When either switch closes, the voltage at node 22 drops. When processor 10 reads buffer 24 it senses the change in state by one of the switches. The processor then commands the motor driver to raise claw 11.

Figure 2:
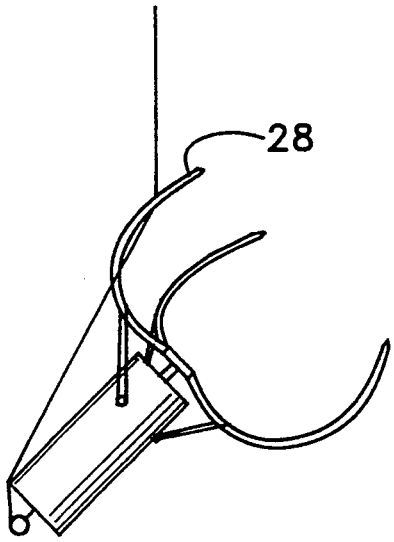
FIG. 2 is an isometric view of the claw entangled with the cable.
Figure 3:
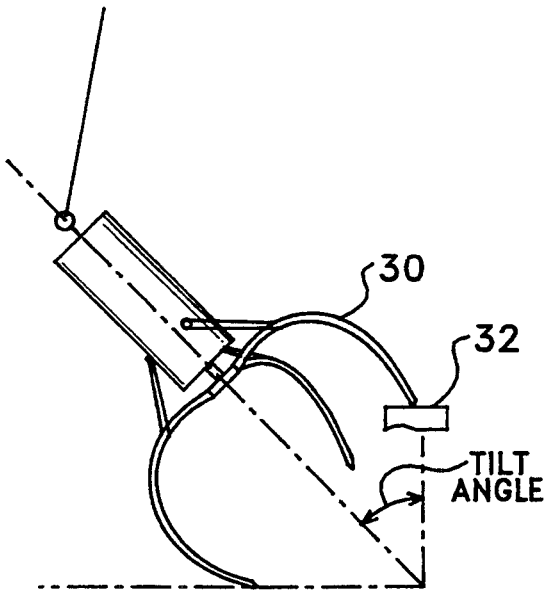
FIG. 3 is an isometric view of the claw tilting to the left.

Claw 11 is raised before it tilts far enough for an arm 28 to hook over cable 16 as shown in FIG. 2. In FIG. 3, arm 30 has landed on an object 32 and the claw is tilting left as cable 16 continues to unreel. Measuring the tilt angle from the vertical as shown in FIG. 3, the tilt switch 18 (FIG. 1) should be set to close at least by the time the tilt angle reaches 140°. This maximum allowed tilt angle of course depends on the design of the claw. The key is that the tilt switch should close before arm 28 can hook over cable 16 (FIG. 2). In the preferred embodiment, the tilt switch closes when the tilt angle reaches 90°. This tilt angle is well inside the range of angles for safe operation, and 90° tilt switches are readily available off-the-shelf. Also 90° switches may be used in normally open or normally closed mode of operation.

While the invention has been described with normally open switches, it will be apparent to one skilled in the art that normally closed switches could be used. It is only necessary that the switches, the buffer and the processor be properly matched. It will be appreciated by one skilled in the art that there are many available designs for the switches, buffers and processors.

While a preferred embodiment of the invention has been shown and described, it will be appreciated by one skilled in the art, that a number of variations or modifications may be made without departing from the spirit and scope of my invention.

What is claimed is:

1. Apparatus for automatically raising a crane claw when said claw tilts, said apparatus comprising:

means for suspending said claw;

means mounted on said claw for detecting a tilt angle of said claw and generating a tilt signal indicating if said claw is tilting more than a predefined angle;

means for raising and lowering said suspending means and thereby said claw;

means for controlling said raising and lowering means, said controlling means sampling the tilt signal from said tilt detecting means and controlling said raising and lowering means to raise said claw when said claw is tilting more than the predefined angle;

means for detecting slack in said suspending means; and said controlling means responsive to said slack detecting means for controlling said raising and lowering means to raise said claw when slack is detected.

2. Apparatus for automatically raising a crane claw when said claw tilts, said apparatus comprising means for suspending said claw;

means mounted on said claw for detecting a tilt angle of said claw and generating a tilt signal indicating if said claw is tilting more than a predefined angle;

means for raising and lowering said suspending means and thereby said claw;

means for controlling said raising and lowering means, said controlling means sampling the tilt signal from said tilt detecting means and controlling said raising and lowering means to raise said claw when said claw is tilting more than the predefined angle;

said tilt detecting means comprises a tilt switch connected to a resistor in a manner such that voltage across the resistor changes when the tilt switch changes between open and closed; and said controlling means comprises a buffer having a bit that changes with voltage changes across the resistor, a micro processor that reads the bit in the buffer and issues control commands to said raising and lowering means.

3. Apparatus for preventing a crane claw from becoming entangled in its suspending cable, said apparatus comprising:

means for lowering the cable and thereby the claw;

means for detecting whether the claw has tilted past a critical tilt angle permitting the claw to become entangled in the cable;

means responsive to said detecting means for raising the cable and thereby the claw if the claw has tilted past said critical tilt angle;

means for detecting slack in the cable; and said raising means responsive to said slack detecting means for raising the cable and thereby the claw if slack is detected.

4. The apparatus of claim 3 wherein said tilt detecting means comprises:

switch means mounted on the claw for switching between open and closed states when the claw tilts past the critical tilt angle, the switching between states being indicative of detection of the claw tilting past the critical angle.

5. In a crane system having a claw, apparatus for preventing arms of the claw from becoming entangled with a cable from which the claw is suspended, said apparatus comprising:

motor means for unreeling and reeling the cable so as to raise and lower the claw;

a processing means for issuing raise/lower control commands to raise and lower the claw;

drive means responsive to the control commands from said processing means for generating up/-down drive signals for said motor means;

means for sensing tilt of the claw relative to the cable and generating a tilt signal indicating the tilt angle of the claw has exceeded a limit;

said processing means responsive to said tilt signal to issue a raise command for the said drive means whereby the claw is raised before the tilt angle is such that an arm of the claw hooks over the cable; and said tilt sensing means senses that the tilt of the claw is just less than a tilt angle, at which an arm of the claw hooks the cable, and generates the tilt signal.

6. In a crane system having a claw, apparatus for preventing arms of the claw from becoming entangled with a cable from which the claw is suspended, said apparatus comprising:

motor means for unreeling and reeling the cable so as to raise and lower the claw;

a processing means for issuing raise/lower control commands to raise and lower the claw;

drive means responsive to the control commands from said processing means for generating up/-down drive signals for said motor means;

means for sensing tilt of the claw relative to the cable and generating a tilt signal indicating the tilt angle of the claw has exceeded a limit;

said processing means responsive to said tilt signal to issue a raise command for the said drive means whereby the claw is raised before the tilt angle is such that an arm of the claw hooks over the cable;

means for sensing the loss of tension in the cable and generating a slack cable signal;

said processing means responsive to said slack cable signal or said tilt signal to issue a raise command for said drive means.

7. The apparatus of claim 6 wherein said tilt sensing means comprises:

switch means mounted on the claw for switching between open and closed states when the claw tilts approximately 140° from the vertical, the switching between states being indicative of the tilt signal.

8. The apparatus of claim 6 wherein said tilt sensing means comprises:

switch means mounted on the claw for switching between open and closed states when the claw tilts approximately 90° from the vertical, the switching between states being indicative of the tilt signal.

* * * * *